US012085284B2

(12) United States Patent
Cai et al.

(10) Patent No.: US 12,085,284 B2
(45) Date of Patent: Sep. 10, 2024

(54) AIR GUIDE BOX AND INTERNAL-CIRCULATION RANGE HOOD HAVING THE SAME

(71) Applicant: NINGBO FOTILE KITCHEN WARE CO., LTD., Zhejiang (CN)

(72) Inventors: Fan Cai, Zhejiang (CN); Fengxu Ye, Zhejiang (CN); Gai Lei, Zhejiang (CN); Ting Yu, Zhejiang (CN); Xiaoqiong Wang, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 253 days.

(21) Appl. No.: 17/776,228

(22) PCT Filed: Dec. 24, 2020

(86) PCT No.: PCT/CN2020/138767
§ 371 (c)(1),
(2) Date: May 12, 2022

(87) PCT Pub. No.: WO2022/021767
PCT Pub. Date: Feb. 3, 2022

(65) Prior Publication Data

US 2022/0381448 A1 Dec. 1, 2022

(30) Foreign Application Priority Data

Jul. 28, 2020 (CN) ..... 202010739565.7

(51) Int. Cl.
*F24C 15/20* (2006.01)

(52) U.S. Cl.
CPC ..... *F24C 15/20* (2013.01)

(58) Field of Classification Search
None
See application file for complete search history.

(56) References Cited

U.S. PATENT DOCUMENTS

2006/0003686 A1* 1/2006 Yamauchi ..... F24F 7/065 454/234
2023/0096069 A1* 3/2023 Goharzadeh ..... B01L 3/0241 366/336

FOREIGN PATENT DOCUMENTS

CN 108800238 11/2018
CN 110015736 A * 7/2019 ..... B01F 13/103
(Continued)

OTHER PUBLICATIONS

"International Search Report (Form PCT/ISA/210) of PCT/CN2020/138767," mailed on Apr. 23, 2021, with English translation thereof, pp. 1-4.

*Primary Examiner* — Joseph A Dillon, Jr.
(74) *Attorney, Agent, or Firm* — JCIPRNET

(57) ABSTRACT

An air guide box includes a box body. The box body includes a first wall and a second wall disposed opposite to each other. The first wall has an air inlet. Air outlets are respectively disposed between corresponding edges of the first and second walls. The second wall is recessed toward the first wall, and a portion of the second wall corresponding to the air inlet is a largest recessed position. From the largest recessed position to the air outlets, the second wall is gradually inclined in a direction away from the first wall, so that an inner surface of the second wall facing the first wall forms guiding slopes respectively form the largest recessed position to the edges of the first and second walls.

9 Claims, 7 Drawing Sheets

(56) References Cited

FOREIGN PATENT DOCUMENTS

| | | | | | |
|---|---|---|---|---|---|
| CN | 209446953 | | | 9/2019 | |
| CN | 210688654 | | | 6/2020 | |
| CN | 111609440 | | | 9/2020 | |
| CN | 111878867 | | | 11/2020 | |
| CN | 111609440 | B | * | 3/2022 | ..... F24C 15/2035 |
| KR | 20050020933 | | | 3/2005 | |

* cited by examiner

AIR GUIDE BOX AND INTERNAL-CIRCULATION RANGE HOOD HAVING THE SAME

CROSS-REFERENCE TO RELATED APPLICATION

This application is a 371 of international application of PCT application serial no. PCT/CN2020/138767, filed on Dec. 24, 2020, which claims the priority benefit of China application no. 202010739565.7, filed on Jul. 28, 2020. The entirety of each of the above mentioned patent applications is hereby incorporated by reference herein and made a part of this specification.

TECHNICAL FIELD

The present invention relates to an oil fume purification device, and in particular to an air guide box and an internal-circulation range having the same.

DESCRIPTION OF RELATED ART

Range hoods have become one kind of indispensable kitchen appliances in modern families. Range hoods operate on the principle of fluid dynamics, suck and exhaust oil fume through centrifugal fans mounted inside the range hoods and filter some oil particles through filter screens. The centrifugal fan comprises a volute, an impeller mounted in the volute and a motor for driving the impeller to rotate. When the impeller rotates, a negative-pressure suction force is generated in the center of the fan, so that oil fume under the range hood is sucked into the fan, accelerated by the fan and then collected by the volute and guided to the outside of the fan hood.

According to the oil fume discharge mode, range hoods can be classified into external exhaust type range hoods and internal circulation type range hoods. In the existing internal-circulation range hoods, oil fume is mainly sucked together with air by the fan system, then adsorbed and filtered by the filter system in the whole machine, and purified and discharged to the outdoor together with air. Since the air discharge volume is relatively large, if air is directly discharged, the discharged air flow will directly blow to the ceiling and form a rebound backflow. After air blows backward, the air will interfere with the user's cooking. Therefore, a box-type air outlet device is generally provided, so that the upward air from the air outlet is divided into left and right air flows for discharging from the top down by the box-type air outlet device.

For example, a Chinese Patent publication of CN108800238A (application no.: 201710294340.3) disclosed an internal-circulation range hood which can purify oil fume into a purified gas, wherein the range hood comprises a collection and guidance device for collecting the purified gas and guiding the purified gas out from the range hood; the collection and guidance device comprises a mounting hanging plate, a decoration hood and a collection mechanism disposed in the decoration hood; and, both the decoration hood and the collection mechanism are fixedly connected to the mounting hanging plate to form the collection and guidance device.

In the collection and guidance device (air guide box), the purified air flow is discharged by a simple barrier structure, and the air flow is refracted on the top inside the air guide box, so that there is a phenomenon of downward air filling, thereby resulting in vortex and affecting the user experience.

With reference to FIG. 9, the air flow formed on the right side of the circular air inlet is vortex. Meanwhile, after being discharged from the air guide box, the air flow directly hits the cabinets on two sides and goes down the cabinets. A part of the oil fume blows to the operator's head along the top of the fume collection hood of the range hood, so that the operation is very uncomfortable. A part of the oil fume goes down along the gaps between the cabinets and the left and right sides of the fume collection hood of the range hood to blow the flame of the cooker, thereby resulting in flame turbulence and affecting the cooking effect. In addition, since there is no any noise reduction design, the produced noise is high.

SUMMARY

A first object of the present invention is to provide an air guide box, which realizes directional air guidance and reduce noise.

A second object of the present invention is to provide an internal-circulation range hood equipped with the air guide box described above.

For achieving the first object, the air guide box includes a box body. The box body includes a first wall and a second wall disposed opposite to each other. The first wall has an air inlet, and air outlets are respectively disposed between corresponding edges of the first wall and the second wall.

The second wall is recessed toward the first wall, and a portion of the second wall corresponding to the air inlet is a largest recessed position. From the largest recessed position to the air outlets, the second wall is gradually inclined in a direction away from the first wall, so that an inner surface of the second wall facing the first wall forms guiding slopes respectively from the largest recessed position to the edges of the first wall and the second wall.

Preferably, the box body is a hexahedron to adapt to the mounting environment. The box body further comprises a third wall and a fourth wall disposed opposite to each other. The third wall and the fourth wall are respectively connected between the corresponding edges of the first wall and the second wall. The air outlets are two in number, and the two air outlets are respectively formed at corresponding end portions of a space enclosed by the first wall, the second wall, the third wall and the fourth wall.

In order to facilitate the guidance and noise reduction of the air flow flowing through the air outlets, preferably, a plurality of grilles are disposed at each air outlet. At least two grilles are disposed at each air outlet, the at least two grilles are sequentially disposed between the third wall and the fourth wall, and the grilles spread over the corresponding air outlets.

Preferably, in order to ensure the directional flow guidance and the contact area with the air flow and achieve the purpose of reducing noise, each grille comprises a first grille wall and a second grille wall disposed at an angle. Each of the first grille wall and the second grille wall has a first end and a second end, the first ends of the first grille wall and the second grille wall are connected to each other, and the second ends of the first grille wall and the second grille wall are away from each other. The first grille wall gradually extends into the box body from the first end to the second end, and the second grille wall gradually extends into the box body from the first end to the second end. The first grille wall has a plurality of first through holes, and the second grille wall has a plurality of second through holes.

Preferably, in order to ensure the directional flow guidance, extend the path passed by sound waves when being transmitted out, increase the number of collisions between sound waves and holes and achieve the purpose of reducing noise, the first grille wall is gradually inclined toward the third wall from the first end relative to the second end, and the first grille wall has a length of L1. The second grille wall is gradually inclined toward the fourth wall from the first end to the second end, and the second grille wall has a length of L2, and the following condition is satisfied: L1<L2.

Preferably, in order to ensure that the air flow will be guided to the first grille wall along the second grille wall and then discharged from the first through holes, the first through holes and the second through holes are circular holes, and an aperture of the first through holes is greater than an aperture of the second through holes.

Preferably, in order to ensure that the vortex will not basically occur at the second grille wall and also ensure the directional flow guidance, an included angle $\alpha$ between a projection of each second grille wall on the first wall and the corresponding end of the first wall, and the included angle $\alpha$ has a value range of 22° to 28°.

In order to further ensure the directional flow guidance, preferably, a distance between the fourth wall and the end of the second grille wall closest to the fourth wall is b, and the distance b is less than or equal to 4 mm.

Preferably, in order to reduce the wind resistance, ensure that the direction of the air flow guided along the second grille wall is consistent with the opening direction of the first through holes, further ensure that the air flow is discharged in a direction perpendicular to the first through holes, further extend the transmission path of sound waves and further achieve the effect of reducing noise, the first grille wall and the second grille wall are perpendicular to each other, and an opening direction of the first through holes is perpendicular to the first grille wall.

Preferably, in order to ensure that the air flow entering from the air inlet can be guided to the desired direction through the grilles, projections of the second grille walls of adjacent grilles on the air outlets are at least partially overlapped.

For achieving the second object, the internal-circulation range hood equipped with the air guide box described above includes a main body. The air inlet of the air guide box is connected to a fume discharge pipe of the main body, the first wall is located below the second wall, and the air outlets are respectively disposed on left and right sides of the box body.

Compared with the prior art, the present invention has the following advantages. The air guide box has a guiding slope on the top surface of the air guide box, and an air flow can be smoothly guided to the air outlets, thus avoiding the vortex caused by the direction rebound of the air out without guidance. By adopting the form of grilles arranged at an angle, directional flow guidance can be ensured, and the purpose of reducing noise can also be achieved by guiding flow, increasing the transmission path of sound waves and in other ways. Compared with common air guide boxes, under the same service conditions, the mechanical noise and the vortex noise are reduced by the structure, and the overall noise produced is relatively low.

DESCRIPTION OF THE EMBODIMENTS

The present invention will be further described in detail below by embodiments with reference to the accompanying drawings.

In the description of the present invention, it should be understood that, the orientation or positional relationship indicated by terms such as "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial" and "circumferential" is based on the orientation or positional relationship shown in the accompanying drawings, and is merely for the convenience of describing the present invention and simplifying the description, rather than indicating or implying the indicated device or element must has a particular orientation or be constructed and operated in a particular orientation. Since the embodiments disclosed in the present invention can be arranged in different directions, these terms indicating direction are merely for illustration and should not be construed as limitations. For example, "upper" and "lower" are not necessarily defined as directions opposite to or consistent with the direction of gravity. In addition, the features defined by the terms "first" and "second" may explicitly or implicitly include one or more features.

Figure 1:
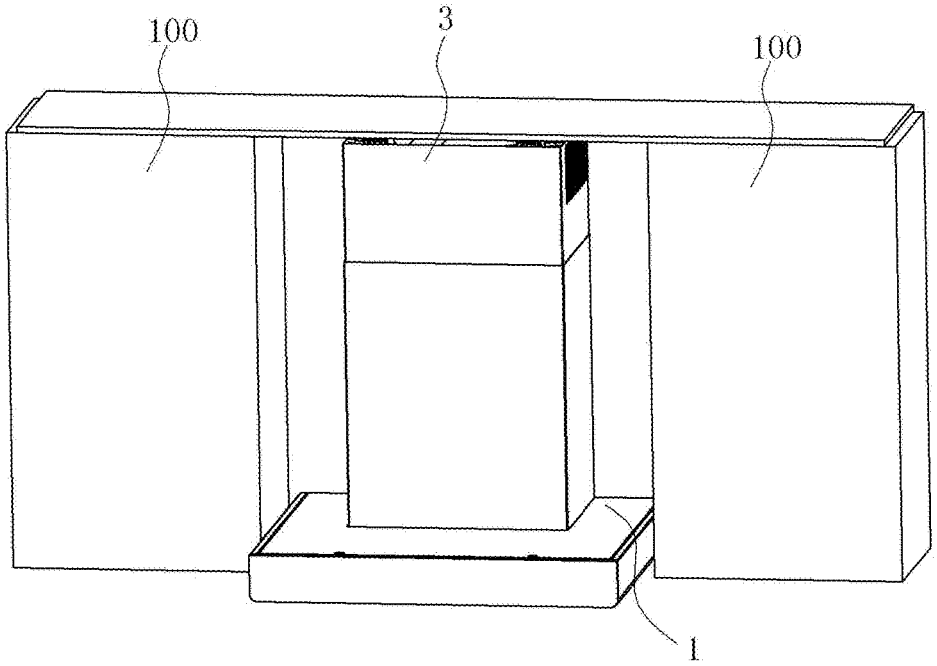
FIG. 1 is a perspective view of a range hood in a mounted state according to an embodiment of the present invention.
Figure 2:
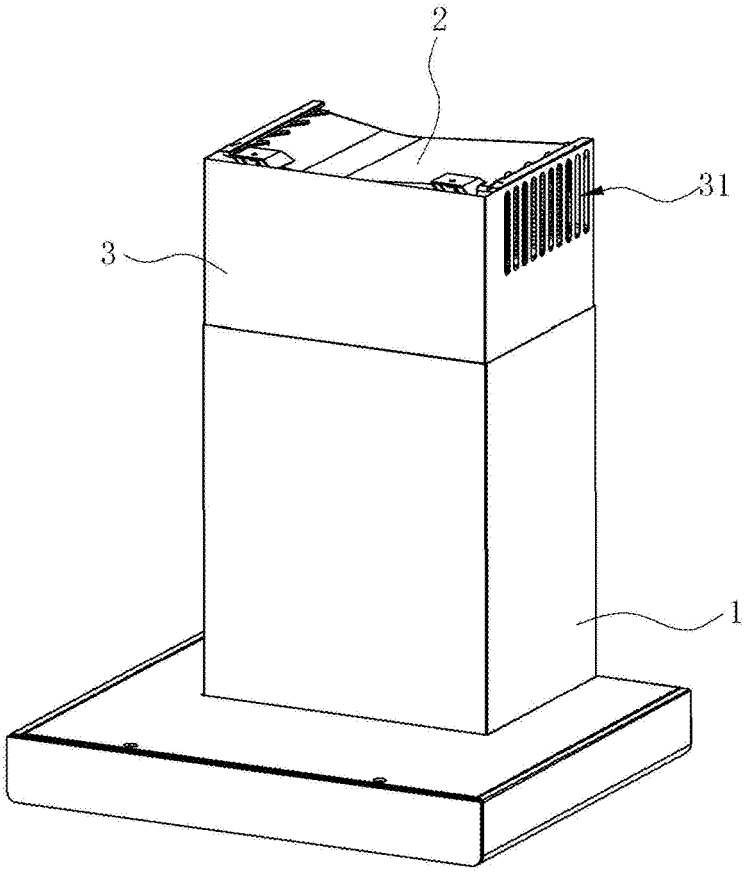
FIG. 2 is a perspective view of the range hood according to the embodiment of the present invention.

FIG. 1 and FIG. 2 show a preferred embodiment of an internal-circulation range hood of the present invention. The internal-circulation range hood comprises a main body 1, an air guide box 2 for discharging fume disposed above the main body 1, and a decoration hood 3 disposed around the air guide box 2.

A part of the main body 1, the air guide box 2 and the decoration hood 3 are disposed between cabinets 100. The air guide box 2 is directly or indirectly connected to an air outlet passage of the main body 1 through an air pipe, and the air guide box 2 guide and discharges a purified oil fume flow from the main body 1 to the kitchen.

Figure 4:
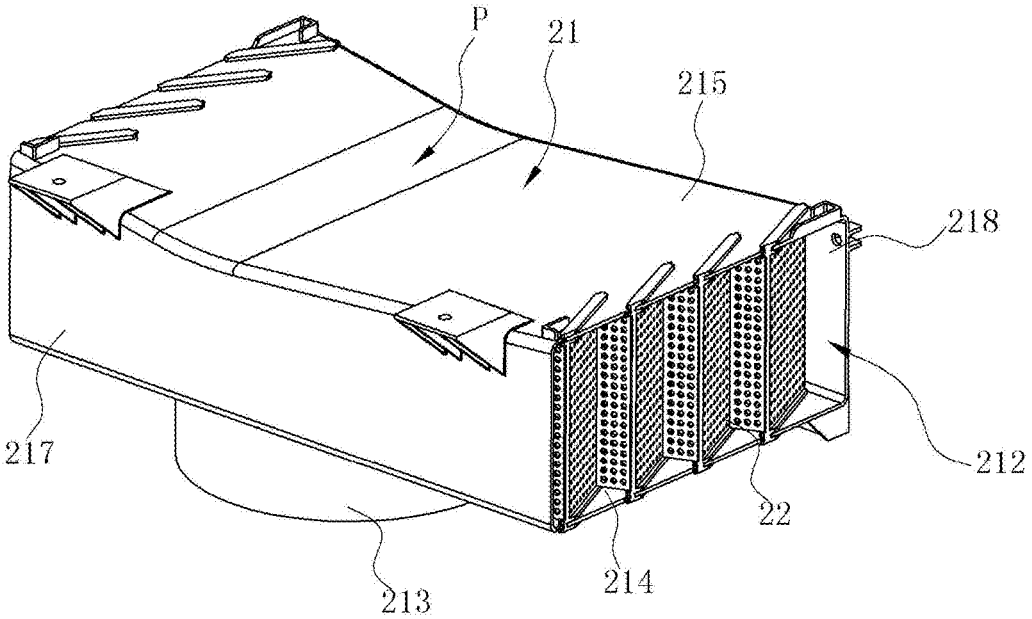
FIG. 4 is a perspective view of an air guide box according to the embodiment of the present invention.
Figure 5:
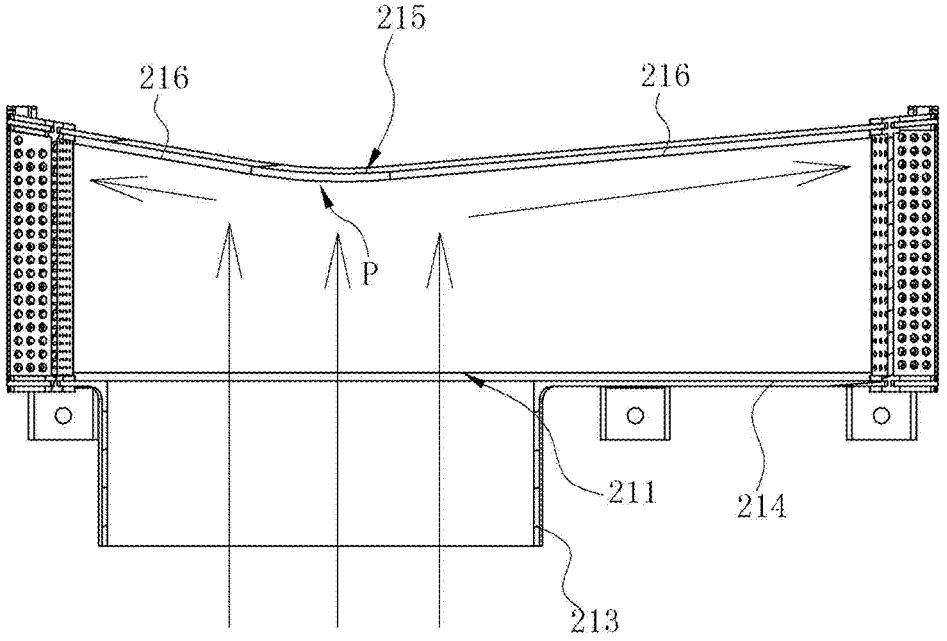
FIG. 5 is a longitudinal sectional view of the air guide box according to the embodiment of the present invention.
Figure 6:
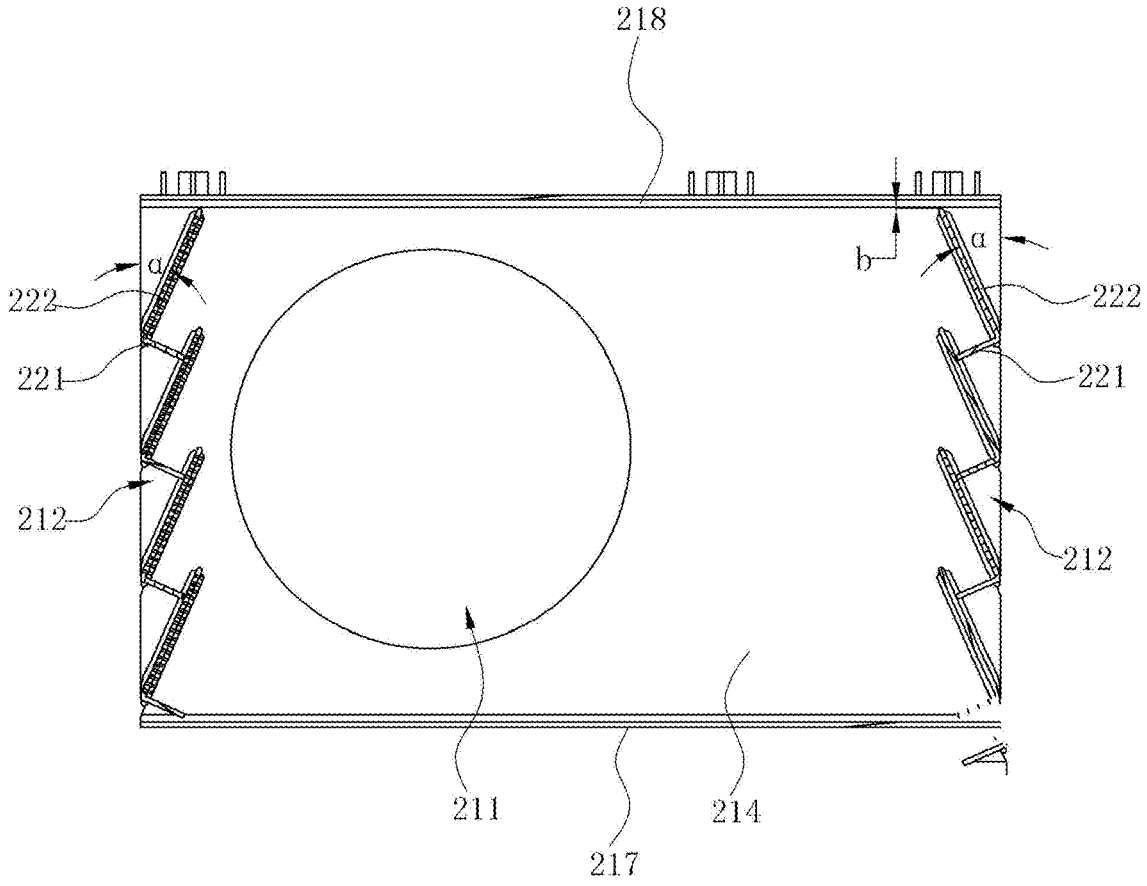
FIG. 6 is a transverse sectional view of the air guide box according to the embodiment of the present invention.

With reference to FIG. 4 to FIG. 6, the air guide box 2 comprises a box body 21, and an air inlet 211 and two air outlets 212 are disposed on the box body 21. In this embodiment, the air guide box 2 is indirectly connected to the main body 1. An air inlet pipe 213 can be disposed at the air inlet 211 to realize the fluid communication between the inside of the box body 21 and a fume discharge port (such as a common air outlet hood) of the main body 1. In the mounted state, the air inlet pipe 213 is formed by extending downward from the bottom surface of the box body 21. There are two air outlets 212 disposed oppositely and respectively located on the left and right sides of the box body 21. Purified air outlets 31 are disposed at positions on the decoration hood 31 corresponding to the air outlets 212 to discharge a gas discharged from the air outlets 212 to the kitchen, so as to form indoor air circulation.

In this embodiment, the box body 21 is a hexahedron, preferably a hollow cuboid. The box body 21 comprises a first wall 214 and a second wall 215 oppositely spaced apart in the up-down direction and a third wall 217 and a fourth wall 218 oppositely spaced apart in the front-rear direction. The third wall 217 and the fourth wall 218 are respectively connected between the corresponding edges of the first wall 214 and the second wall 215. In the mounted state, the first wall 214 forms the bottom portion of the box body 21, the second wall 215 forms the top portion of the box body 21, the third wall 217 forms the front side of the box body 21, and the fourth wall 218 forms the rear side of the box body 21. The air inlet 211 is disposed on the first wall 214, and the left and right sides of the space enclosed by the first wall 214, the second wall 215, the third wall 217 and the fourth wall 218 are opened to form the two air outlets 212. That is, the two air outlets 212 are respectively formed on the corresponding left edge and right edge of the first wall 214 and the second wall 215.

In addition, the second wall 215 is recessed toward the first wall 214. A portion of the second wall 215 corresponding to the air inlet 211 is the largest recessed position P. That is, the largest recessed position P of the second wall 215 just corresponds to the air inlet 211. The second wall 215 gradually extends obliquely from the position corresponding to the air inlet 211 to the air outlets 212 in a direction away from the first wall 214. Thus, the inner surface of the second wall 215 facing the first wall 214 forms guiding slopes 216 respectively extending from the middle to two ends (left and right ends). The guiding slopes 216 may be flat surfaces or curved surfaces.

Figure 10:
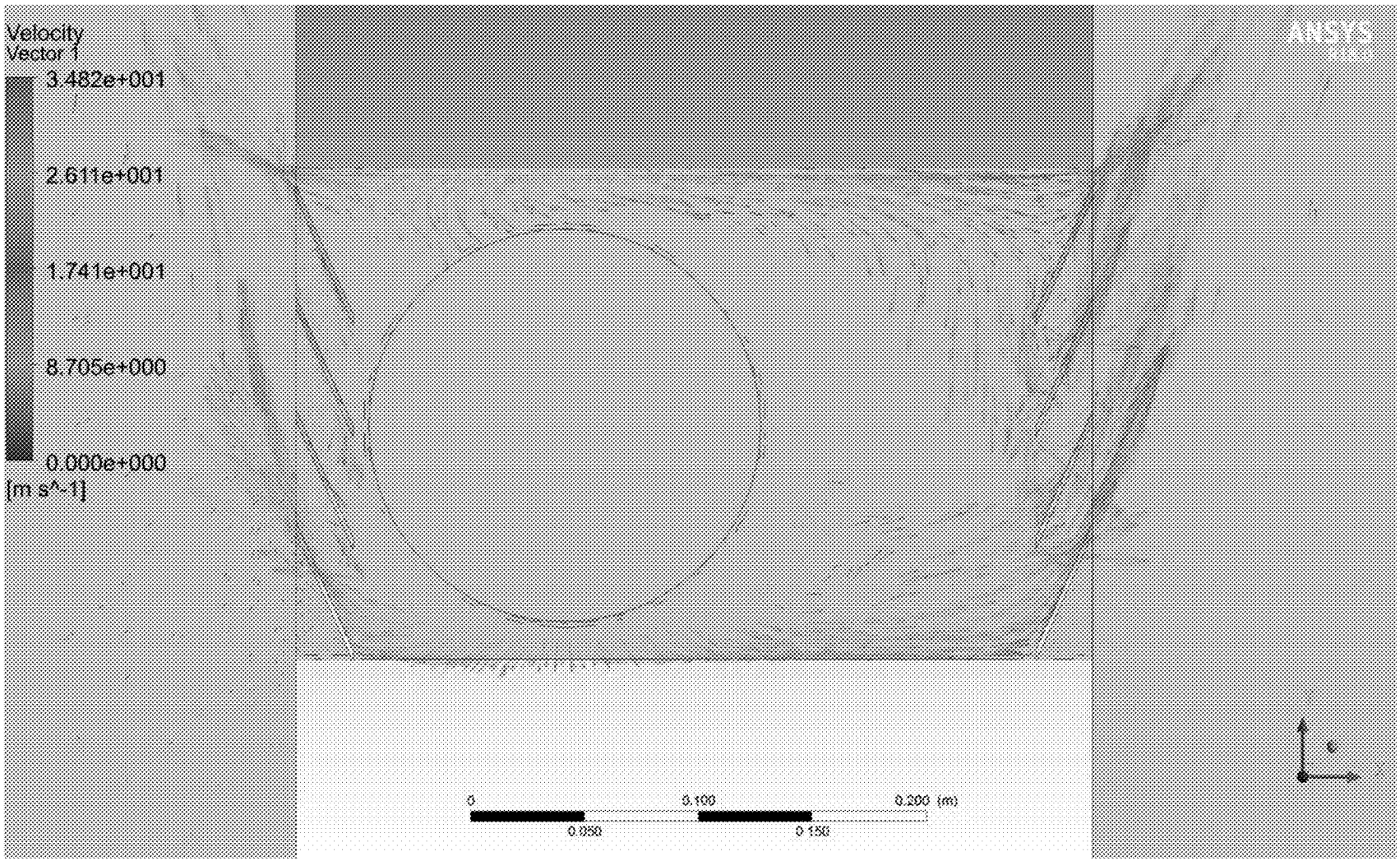
FIG. 10 is a schematic diagram of flow guidance simulation of the air guide box after a guiding slope inclined upward is provided according to the embodiment of the present invention.

The flowing direction of air is indicated by the arrow in FIG. 4, so that the air flow entering from the air inlet 211 from bottom to top can be guided obliquely upward along the guiding slopes 216 by using the "wall attachment effect". In addition, it can be largely avoided that the air flow blows to the top of the box body 21 and directly bounces back without guidance to result in a turbulence (vortex) phenomenon, with reference to FIG. 10.

That is, by guiding air obliquely upward, the turbulence (vortex) phenomenon is avoided. Meanwhile, by guiding the air flow obliquely upward, the air flow will slightly go downward in the process of guiding from the air outlets 212 of the box body 21. Compared with the existing horizontal direct blowing, this path that goes upward and then slightly goes downward will increase the discharge path of the air flow, so that the energy consumed by the air flow is increased and the noise produced by the air flow is reduced.

Figure 7:
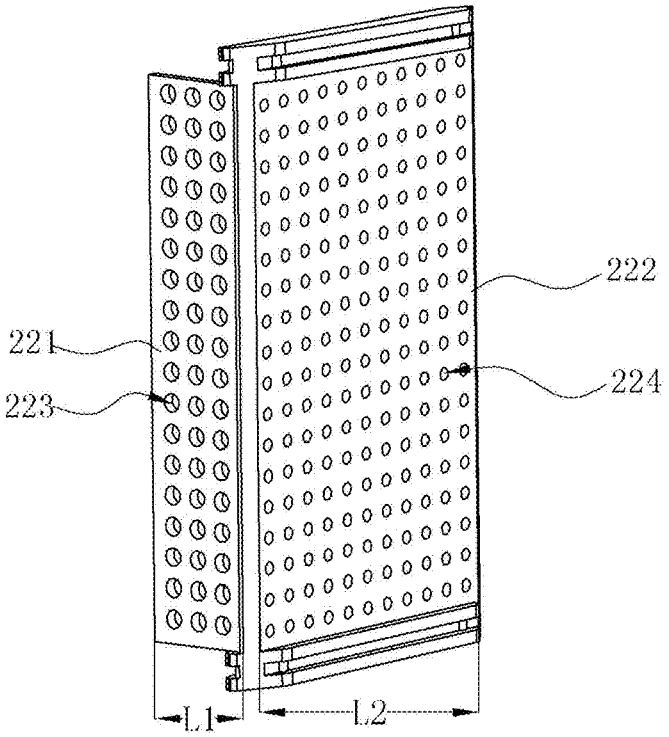
FIG. 7 is a perspective view of two grilles of the air guide box according to the embodiment of the present invention.

A plurality of grilles 22 are disposed at each air outlet 212. At least two grilles 22 are disposed at each air outlet 212, the at least two grilles 22 are sequentially disposed between the third wall 217 and the fourth wall 218, and the grilles 22 spread over the whole air outlets 212. With reference to FIG. 7, each grille 22 comprises a first grille wall 221 and a second grille wall 222 disposed at an angle. Each of the first grille wall 221 and the second grille wall 222 has a first end and a second end. The first ends of the first grille wall 221 and the second grille 222 are connected to each other, and the second ends of the first grille wall 221 and the second grille wall 222 are away from each other. The grille 22 is of an integrated structure. In this embodiment, the two grille walls are perpendicular to each other, so that the grille 22 is L-shaped as a whole. The first grille wall 221 has a length (the distance between the first end and the second end that are parallel to each other) of L1, the second grille wall (222) has a length (the distance between the first end and the second end that are parallel to each other) of L2, and the following condition is satisfied: $L1<L2$. The first grille wall 221 has a plurality of first through holes 223, and the second grille wall 222 has a plurality of second through holes 224, and the first through holes 223 and the second through holes 224 are disposed in an array.

The first grille wall 21 gradually extends into the box body 2 from the first end to the second end, and the first grille wall 221 is gradually inclined toward the third wall 217 from the first end relative to the second end. The second grille wall 222 gradually extends into the box body 21 from the first end to the second end, and the second grille wall 222 is gradually inclined toward the fourth wall 218 from the first end to the second end. Since the air flow is guided obliquely upward along the second wall 215 of the box body 21, the air flow forms a certain angle with the second through holes 224 on the second grille wall 222, the air flow cannot be directly discharged from the second through holes 224 and will be guided to the first grille wall 221 along the second grille wall 222 for discharging. In addition, since the flowing direction of the air flow forms a certain angle with the first through holes 223 and with the second through holes 224, for the noise produced by the air flow, the path passed by sound waves when being transmitted is extended, the number of collisions between sound waves and holes is increased, and the purpose of reducing noise is also achieved.

An included angle $\alpha$ between the projection of each second grille wall 222 on the first wall 214 and the corresponding end of the first wall 214, and the included angle $\alpha$ has a value range of 22° to 28°. Within this angle range, it can be ensured that the vortex will not basically occur at the second grille wall 222, and the vortex is a major source for noise production. If the included angle $\alpha$ is too small, in order to ensure the flow guiding direction, since two adjacent grilles 22 must be overlapped, the distance between two grilles 22 will also decrease simultaneously, so that the resistance area of the air flow when being discharged will increase quickly. The increase of resistance will increase the difficulty of air discharge and thus produce higher noise. If the included angle $\alpha$ is too large, the air flow will be guided out from the distances between the fourth wall 218 and the grilles 22, and the distance between the fourth wall 218 and the end of the second grille wall 222 closest to the fourth wall 218 is b, and the distance b is less than or equal to 4 mm. If the distance b is too large, the air flow will be guided out from the distance b. However, this flow guiding direction is not an ideal flow guiding direction. In addition, if the included angle $\alpha$ is too large, the ideal flow guiding direction cannot be realized, and the guided air will blow to the operator's head and lead to the turbulence of the flame of the cooler, which goes against the original design intention.

Figure 11:
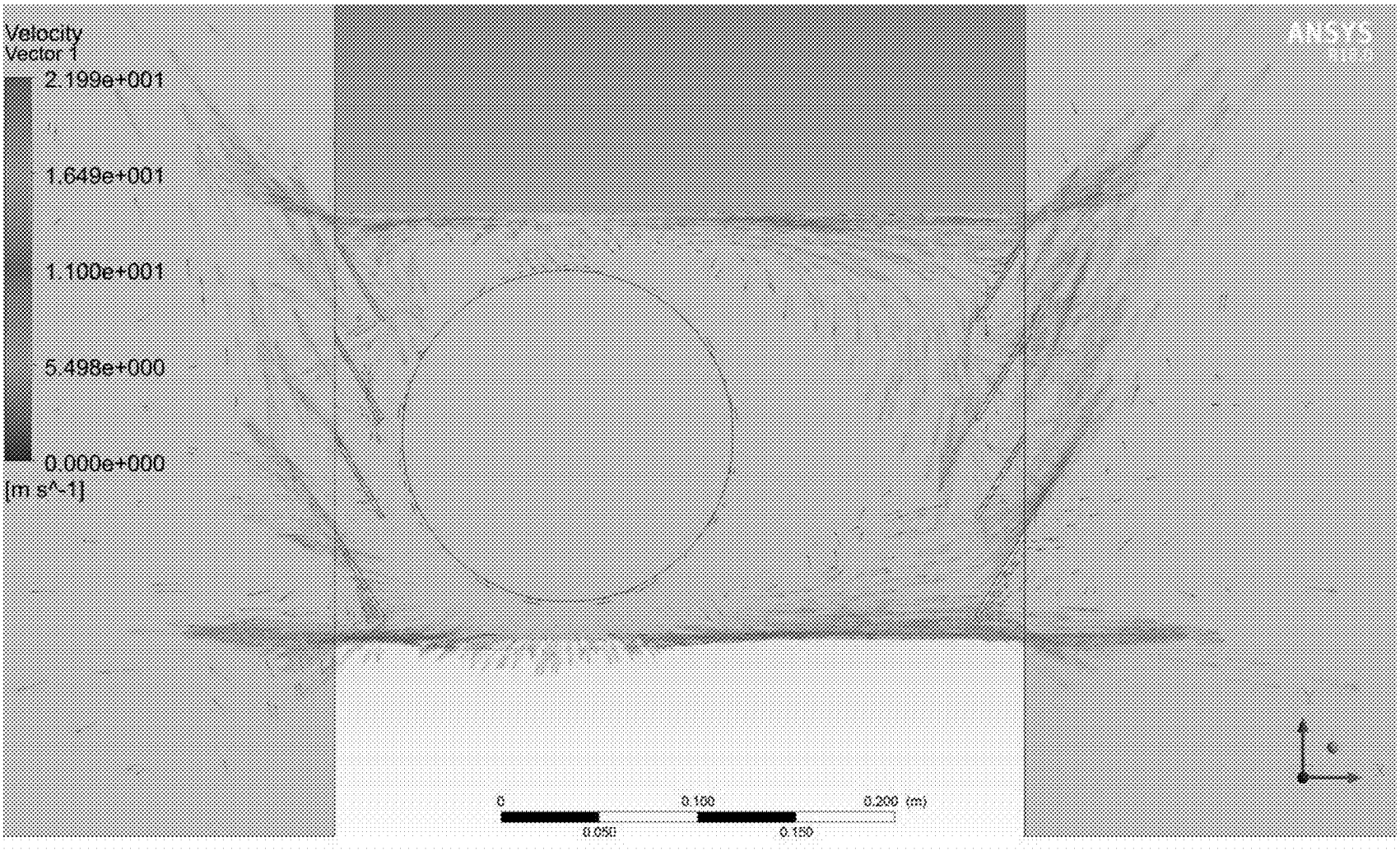
FIG. 11 is a schematic diagram of flow guidance simulation of the air guide box after the length and angle of the grilles are set according to the embodiment of the present invention.

If the grilles 22 are improper in length or there are no grilles, the vortex phenomenon will occur. Meanwhile, when the grilles 22 are improper in length or there are no grilles, the air flow cannot be guided to the desired air outlet direction. The projections of the second grille walls 222 of adjacent grilles 22 on the air outlets 212 are at least partially overlapped, thereby ensuring that the air flow entering from the air inlet 21 can be guided to the desired directed through the grilles 22, with reference to FIG. 11.

By using the optimized design in structure, the air guide box greatly eliminates the vortex phenomenon. The vortex in the fluid is a major source of noise production. By eliminating the vortex, the major source of noise production is eliminated, so that the purpose of reducing noise is achieved.

By the configuration of the first through holes 223 and the second through holes 224, the purpose of reducing noise can be further achieved. Under the action sound waves, the air column in the holes will do a reciprocating motion like a piston. Due to the damping effect of the hole walls on the air, a part of sound is converted into heat energy. When the frequency of the incoming sound waves is consistent with the inherent frequency of the grilles, the resonance phenomenon will occur. At this time, the air column in the holes has the highest speed of movement, so that the damping effect is largest, and the sound energy can be absorbed to the greatest extent in this case to absorb sound, thereby achieving the purpose of reducing noise.

As described above, the grilles 22 are L-shaped. The grilles 22 in this form ensures the directional flow guidance, increases the contact area between the grilles 22 and the air flow, and ensures that the total area of all holes is consistent with the area of the air outlets 212 without the grilles 22. In accordance with the frequency spectrum principle of the air injection noise, if the total area of nozzles remains unchanged and many small nozzles are used instead, when the air flow passes through small holes, the frequency spectrum of the air injection noise will shift to high frequency or ultrahigh frequency, and the audible sound components in the frequency spectrum can be obviously reduced, thereby achieving the purpose of reducing noise.

Figure 8:
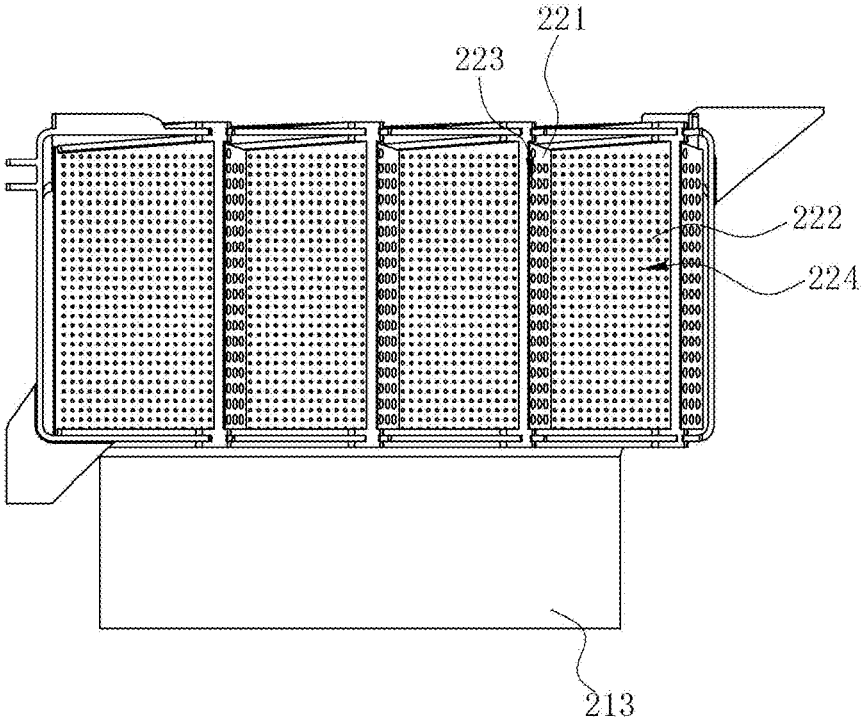
FIG. 8 is a side view of the air guide box according to the embodiment of the present invention.
Figure 9:
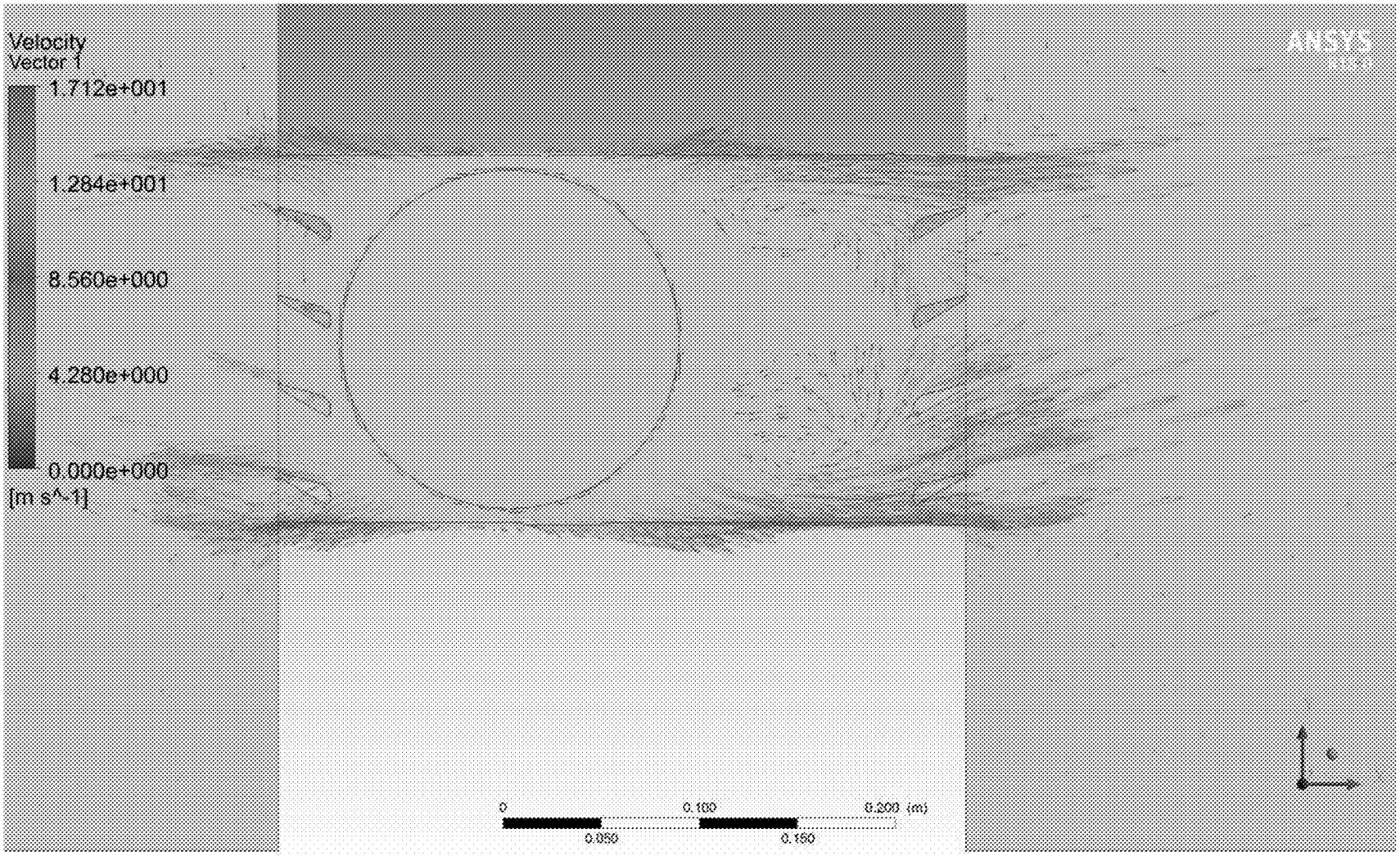
FIG. 9(Prior Art)
FIG. 9 is a schematic diagram of flow guidance simulation of an air guide box in the prior art.

The first through holes 223 and the second through holes 224 are both circular holes, and the aperture of the first through holes 223 is greater than the aperture of the second through holes 224. The aperture of the first through holes 223 has a value range of 3 mm to 5 mm, and the aperture of the second through holes 224 is less than or equal to 1.2 mm. Preferably, the aperture of the first through holes 223 is three times of the aperture of the second through holes 224. Due to the difference in aperture, the pressure relief ability is weaker at the second grill walls 222 of the grilles 22 and stronger at the first grille walls 221, thereby ensuring the air flow will be guided to the first grille walls 221 along the second grille walls 222 and then discharged through the first through holes 223. In addition, the opening direction of the second through holes 224 on the second grille walls 222 (the opening direction of the second through holes 224 is perpendicular to the second grille walls 222) also forms an angle $\alpha$ with the blowing direction of the air flow. When viewed from the left and right sides of the air guide box to the inside, the inside of the air guide box cannot be viewed through the second through holes 224. Thus, it is ensured that the air flow will not be directly discharged through the second through holes 224 on the second grille walls 222. With reference to FIG. 8, it is ensured that the air flow blows to the second grille walls 222 and will be basically guided to the first grille walls 221. The first grille walls 221 and the second grille walls 222 are perpendicular to each other, thereby reducing the wind resistance. The opening direction of the first through holes 223 is perpendicular to the first grille walls 221, so that the direction of the air flow guided along the second grille walls 22 is consistent with the opening direction of the first through holes 223, and it is further ensured that the air flow is discharged in a direction perpendicular to the first through holes 223. The discharge direction is a direction inclined toward the third wall 217 (inclined forward).

Since the opening direction of the second through holes 224 on the second grille walls 222 also forms an angle $\alpha$ with the blowing direction of the air flow, when viewed from the left and right sides of the air guide box to the inside, the inside of the air guide box cannot be viewed through the second through holes 224. Thus, the flow guide requirements are ensured, and the transmission path of sound waves is also further extended. As a result, sound waves cannot be directly transmitted through the second through holes 224 on the second grille walls 222 and can enter the first through holes 223 only after being steered. After the sound waves enter the first through holes 223, due to a certain angle with the first through holes 223, the sound waves can be transmitted only after they are refracted in the first through holes 223 for multiple times. Thus, the transmission path of the sound waves is extended, the collision probability is increased, and the energy of the sound waves is consumed, and the effect of reducing noise is further achieved.

Figure 3:
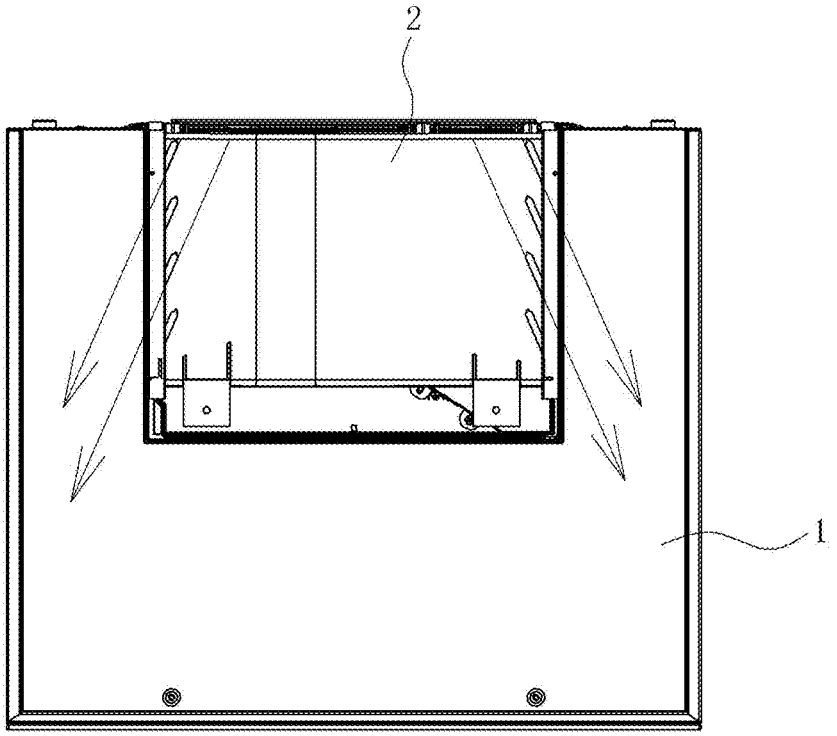
FIG. 3 is a top view of the range hood according to the embodiment of the present invention.

By using the optimized design of the air guide box 2, at different distances to cabinets 100 on two sides of the range hood, it can be ensured that the air flow is guided forward and upward, and it is ensured that oil fume keeps away from the cabinets 100 on the left and right sides without producing any vortex. With reference to FIG. 3, the arrow indicates the path of the air flow when guided out from the air guide box 2. The outgoing air flow is discharged to the kitchen in the direction indicated by the arrow, and the air flow is prevented from blowing to the user's head and resulting in the turbulence of the flame of the cooker. Meanwhile, when the length and position of the grilles 22 are set as mentioned above, it is ensured that the guided air flow is discharged forward to the kitchen only in the direction indicated by the arrow. In addition, by providing upward flow guide structures at the left and right ends of the air guide box, an upward lifting force is provided to the discharged oil fume, so that the discharged oil fume will not sink immediately and is prevented from directly blowing to the operator's head.

The term "fluid communication" in the present invention refers to a spatial positional relationship between two components or parts (hereinafter collectively referred to as the first part and the second part), that is, the fluid (gas, liquid or a mixture thereof) can flow and/or be transported from the first part to the second part along the flowing path. The first part and the second part may be directly communicated with each other, or may be indirectly communicated with each other through at least one third party. The third party may be fluid passages such as pipes, passages, ducts, flow guide members, holes or grooves, or may be chambers for allowing the fluid to flow therethrough, or combinations thereof.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An air guide box, comprising a box body;

wherein the box body comprises a first wall and a second wall disposed opposite to each other;

the first wall has an air inlet;

air outlets are respectively disposed between corresponding edges of the first wall and the second wall;

the second wall is recessed toward the first wall, and a portion of the second wall corresponding to the air inlet is a largest recessed position; from the largest recessed position to the air outlets, the second wall is gradually inclined in a direction away from the first wall, so that an inner surface of the second wall facing the first wall forms guiding slopes respectively from the largest recessed position to the edges of the first wall and the second wall, wherein the box body further comprises a third wall and a fourth wall disposed opposite to each other;

the third wall and the fourth wall are respectively connected between the corresponding edges of the first wall and the second wall; and the air outlets are two in number, and the two air outlets are respectively formed at corresponding end portions of a space enclosed by the first wall, the second wall, the third wall and the fourth wall, wherein a plurality of grilles are disposed at each of the air outlets;

at least two of the grilles are disposed at each air outlet, the at least two grilles are sequentially disposed between the third wall and the fourth wall, and the grilles spread over the corresponding air outlets.

2. The air guide box of claim 1, wherein each grille comprises a first grille wall and a second grille wall disposed at an angle;

each of the first grille wall and the second grille wall has a first end and a second end, the first ends of the first grille wall and the second grille wall are connected to each other, and the second ends of the first grille wall and the second grille wall are away from each other;

the first grille wall gradually extends into the box body from the first end to the second end, and the second grille wall gradually extends into the box body from the first end to the second end;

the first grille wall has a plurality of first through holes, and the second grille wall has a plurality of second through holes.

3. The air guide box of claim 2, wherein the first grille wall is gradually inclined toward the third wall from the first end relative to the second end, and the first grille wall has a length of L1;

the second grille wall is gradually inclined toward the fourth wall from the first end to the second end, the second grille wall has a length of L2, and the following condition is satisfied: L1<L2.

4. The air guide box of claim 3, wherein the first through holes and the second through holes are circular holes, and an aperture of the first through holes is greater than an aperture of the second through holes.

5. The air guide box of claim 3, wherein an included angle $\alpha$ between a projection of each second grille wall on the first wall and a corresponding end of the first wall, and the included angle $\alpha$ has a value range of 22° to 28°.

6. The air guide box of claim 3, wherein a distance between the fourth wall and an end of the second grille wall closest to the fourth wall is b, and the distance b is less than or equal to 4 mm.

7. The air guide box of claim 3, wherein the first grille wall and the second grille wall are perpendicular to each other, and an opening direction of the first through holes is perpendicular to the first grille wall.

8. The air guide box of claim 3, wherein projections of the second grille walls of adjacent grilles on the air outlets are at least partially overlapped.

9. An internal-circulation range hood equipped with the air guide box of claim 1, comprising:

a main body;

wherein the air inlet of the air guide box is connected to a fume discharge pipe of the main body, the first wall is located below the second wall, and the air outlets are respectively disposed on left and right sides of the box body.

* * * * *